US009033465B2

(12) United States Patent
Komatsu

(10) Patent No.: US 9,033,465 B2
(45) Date of Patent: May 19, 2015

(54) FLOW PATH UNIT, LIQUID EJECTING HEAD, LIQUID EJECTING APPARATUS, AND FLOW PATH UNIT MANUFACTURING METHOD

(71) Applicant: Seiko Epson Corporation, Tokyo (JP)

(72) Inventor: Yuko Komatsu, Suwa (JP)

(73) Assignee: SEIKO EPSON CORPORATION (JP)

( * ) Notice: Subject to any disclaimer, the term of this patent is extended or adjusted under 35 U.S.C. 154(b) by 0 days.

(21) Appl. No.: 14/180,624

(22) Filed: Feb. 14, 2014

(65) Prior Publication Data

US 2014/0240400 A1 Aug. 28, 2014

(30) Foreign Application Priority Data

Feb. 22, 2013 (JP) ..... 2013-033185

(51) Int. Cl.

| | |
|---|---|
| ***B41J 2/135*** | (2006.01) |
| ***B41J 2/16*** | (2006.01) |
| ***B41J 2/14*** | (2006.01) |

(52) U.S. Cl.

CPC ..... *B41J 2/1606* (2013.01); *B41J 2/14233* (2013.01); *B41J 2/161* (2013.01); *B41J 2/1642* (2013.01); *B41J 2/1623* (2013.01); *B41J 2/1632* (2013.01)

(58) Field of Classification Search

CPC ..... B41J 2/1606; B41J 2/162; B41J 2/1433; B41J 2/1631; B41J 2/1642; B41J 2/14129; B41J 2/1628; B41J 2/1603; B41J 2/1404; B41J 2/1639; B41J 2202/11

See application file for complete search history.

(56) References Cited

U.S. PATENT DOCUMENTS

| | | | | |
|---|---|---|---|---|
| 6,808,250 | B2 | 10/2004 | Watanabe | |
| 2005/0151797 | A1 * | 7/2005 | Sakamoto et al. | 347/64 |

FOREIGN PATENT DOCUMENTS

| | | |
|---|---|---|
| JP | 05-060844 | 8/1993 |
| JP | 10-250078 | 9/1998 |
| JP | 2007-309328 A | 11/2007 |

* cited by examiner

*Primary Examiner* — Lisa M Solomon

(74) *Attorney, Agent, or Firm* — Harness, Dickey & Pierce, P.L.C.

(57) ABSTRACT

A flow path unit having a liquid flow path through which liquid flows includes a first flow path substrate that forms a flow path wall of the liquid flow path, a second flow path substrate that forms a flow path wall of the liquid flow path, and a coating film that is provided on an area from a coating portion for coating the flow path wall of the first flow path substrate to a fixing portion for fixing the first flow path substrate and the second flow path substrate. Provided are the flow path unit in which the liquid flow path is coated with the coating film without inhibiting fixing of the substrates, a liquid ejecting head, a liquid ejecting apparatus, and a flow path unit manufacturing method.

10 Claims, 9 Drawing Sheets

FLOW PATH UNIT, LIQUID EJECTING HEAD, LIQUID EJECTING APPARATUS, AND FLOW PATH UNIT MANUFACTURING METHOD

BACKGROUND

1. Technical Field

The present invention relates to a flow path unit including a liquid flow path through which liquid flows, a liquid ejecting head including the flow path unit, a liquid ejecting apparatus, and a flow path unit manufacturing method.

2. Related Art

Known has been an existing liquid ejecting head including a liquid flow path through which liquid flows. The liquid ejecting head has a configuration in which an opening for filling the liquid and an opening for ejecting the liquid are connected through the liquid flow path. The liquid ejecting head is formed by superimposing a plurality of substrates. The liquid flow path is also formed by combining grooves and holes formed in the respective substrates (for example, see JP-A-2007-309328).

Disclosed is a configuration in which the liquid flow path is coated with a coating film in order to protect a wall surface of the liquid flow path from the liquid (for example, see, JP-UM-A-5-60844 and JP-A-10-250078).

When the substrates constituting the liquid ejecting head are fixed to each other, the coating film formed on the substrate inhibits the fixing of the substrates in some cases. In this case, it is necessary to remove the coating film by, for example, washing a portion of the substrate on which another substrate is superimposed after the coating film is formed on the substrate. Alternatively, it can be also considered that the coating film is formed on the liquid flow path after the substrates are fixed to each other. In this case, it is, however, difficult to form the coating film appropriately in some cases when the liquid flow path is sealed by the substrate or when the configuration of the liquid flow path is complicated.

SUMMARY

An advantage of some aspects of the invention is to provide a flow path unit in which a liquid flow path is coated with a coating film for making it easy to fix substrates, a liquid ejecting head, a liquid ejecting apparatus, and a flow path unit manufacturing method.

A flow path unit according to an aspect of the invention having a liquid flow path through which liquid flows includes a first flow path substrate that forms a flow path wall of the liquid flow path, a second flow path substrate that is superimposed on and fixed to the first flow path substrate and forms a flow path wall of the liquid flow path, and a coating film that is provided continuously on a coating portion for coating the flow path wall of the first flow path substrate and a fixing portion for fixing the first flow path substrate and the second flow path substrate.

In the aspect of the invention configured as described above, the coating film is provided continuously on the portion for coating the liquid flow path and the portion for fixing the substrates to each other. Therefore, the liquid flow path can be coated with the coating film without inhibiting the fixing of the first flow path substrate and the second flow path substrate. The coating film may include the one that has spaces to an extent that functions of the coating film are not interfered when being observed in an enlarged manner.

In the flow path unit according to the aspect of the invention, it is preferable that a material of the coating film be a thermoplastic resin.

In the aspect of the invention configured as described above, the substrates can be fixed to each other by applying heat to the fixing portion of the coating film. This can fix the substrates easily.

As the thermoplastic resin, a polypropylene-based resin, a polyethylene-based resin, a polystyrene-based resin, and a paraxylene-based resin that are well known can be applied.

In the flow path unit according to the aspect of the invention, it is preferable that a material of the coating film be the same in at least a part of the coating portion and a part of the fixing portion.

In the aspect of the invention configured as described above, a configuration in which a part of the coating portion for coating the liquid flow path and a part of the fixing portion for fixing the substrates to each other are made of the same material and other parts of them are made of different materials may be employed. Therefore, viscosity, strength, chemical resistance, and the like of the materials that are used can be combined optimally based on shapes of portions on which the film is formed and usage conditions thereof.

In the flow path unit according to the aspect of the invention, it is preferable that the first flow path substrate be coated with the coating film of which material is the same in the coating portion and the fixing portion.

In the flow path unit according to the aspect of the invention, it is preferable that a thickness of the fixing portion be set to be larger than a thickness of the coating portion.

In the aspect of the invention configured as described above, different coating films are formed on the first flow path substrate and the second flow path substrate, and then, these coating films are connected so as to form the fixing portion.

In the flow path unit according to the aspect of the invention, it is preferable that any one of the first flow path substrate and the second flow path substrate be made of ceramics.

When the substrate forming the liquid flow path is made of ceramics, components of liquid such as a solution leak from the liquid flow path in some cases if a film thickness thereof is small.

The aspect of the invention configured as described above can suppress the leakage of the solution in the substrate.

The aspect of the invention can be also applied to a liquid ejecting head including the flow path unit according to the aspect of the invention and a nozzle plate including a nozzle hole communicating with the liquid flow path.

The aspect of the invention can be also applied to a liquid ejecting apparatus including the liquid ejecting head as described above. Further, the aspect of the invention can be grasped as a method of manufacturing the liquid ejecting head or the liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention are described in accordance with the following order.

First Embodiment

Second Embodiment

Other Embodiments

First Embodiment

Figure 1:
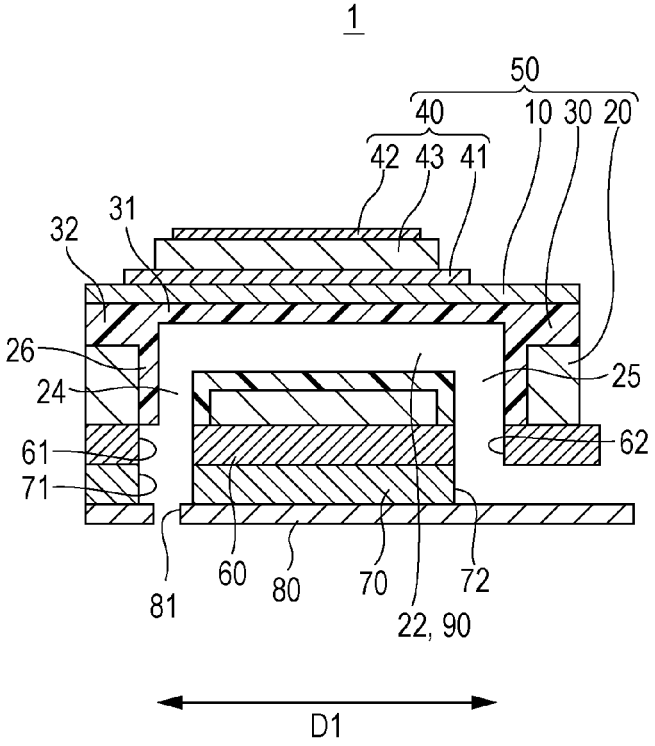
FIG. 1 is a cross-sectional view for explaining a configuration of a liquid ejecting head.
Figure 2:
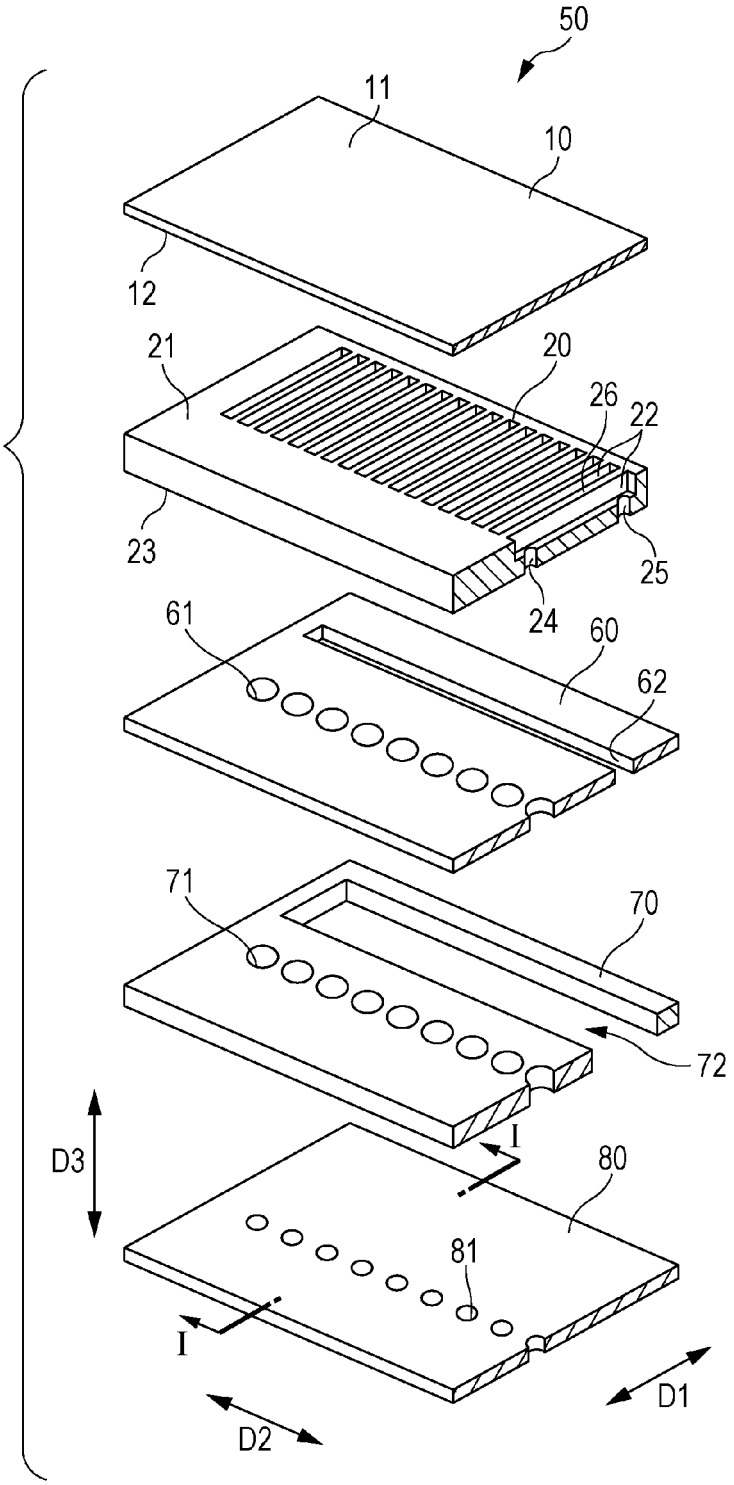
FIG. 2 is a perspective developed view for explaining the configuration of the liquid ejecting head.
Figure 3:
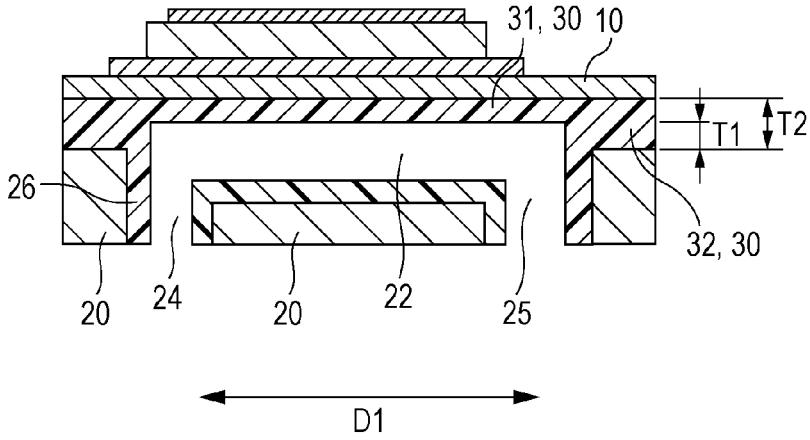
FIG. 3 is a cross-sectional view illustrating a configuration of a flow path unit.

Hereinafter, a first embodiment to which a liquid ejecting head according to the invention is embodied is described with reference to the drawings. FIG. 1 is a cross-sectional view for explaining a configuration of the liquid ejecting head. FIG. 2 is a perspective developed view for explaining the configuration of the liquid ejecting head. FIG. 3 is a cross-sectional view illustrating a configuration of a flow path unit. FIG. 1 corresponds to a cross-sectional view cut along a line I-I in FIG. 2.

A liquid ejecting head 1 is used as a part of a liquid ejecting apparatus such as a printing apparatus. The liquid ejecting head 1 includes a flow path unit 50, a sealing plate 60, a reservoir plate 70, and a nozzle plate 80. In the liquid ejecting head 1, the flow path unit 50, the sealing plate 60, the reservoir plate 70, and the nozzle plate 80 as mentioned above are combined by superimposing them in a laminate manner so as to form a liquid flow path 90 therein.

The flow path unit 50 includes a vibration plate 10, a flow path formation substrate 20, a coating film 30, and piezoelectric elements 40. In the first embodiment, the vibration plate 10 corresponds to a first flow path substrate and the flow path formation substrate 20 corresponds to a second flow path substrate. Although description is made while the flow path unit 50 includes the piezoelectric elements 40 in the embodiment, the flow path unit 50 may not include the piezoelectric elements 40.

As illustrated in FIG. 2, on the flow path formation substrate 20, a plurality of pressure chambers 22 are defined by a wall portion 26 so as to be aligned in parallel in a second direction D2. Further, the respective pressure chambers 22 are formed so as to open at the side of an upper surface 21 of the flow path formation substrate 20. The wall portion 26 defines communication hole-side openings 24 and a reservoir-side opening 25 at the side of a lower surface 23 of the flow path formation substrate 20. The communication hole-side openings 24 and the reservoir-side opening 25 communicate with the respective pressure chambers 22.

In the embodiment, the pressure chambers 22, the communication hole-side openings 24, and the reservoir-side opening 25 are provided on the same flow path formation substrate 20. Alternatively, substrates may be separated into a substrate on which the pressure chambers 22 are formed and a substrate on which the communication hole-side openings 24 and the reservoir-side opening 25 are formed.

The flow path formation substrate 20 is configured by laminating thin plate members made of ceramics. As a material thereof, partially-stabilized zirconia (Zr) or stabilized zirconia can be used.

The vibration plate 10 is fixed to the flow path formation substrate 20 at the upper surface 21 side. Therefore, openings of the respective pressure chambers 22 in the flow path formation substrate 20 are sealed by the vibration plate 10. The vibration plate 10 is configured by a thin plate member made of ceramics, for example. As a material thereof, partially-stabilized zirconia, stabilized zirconia, or silicon dioxide ($SiO_2$) can be used. In addition, a thickness of the vibration plate 10 in a third direction D3 can be set to 2.0 μm to 5.4 μm, for example.

As illustrated in FIG. 1, the coating film 30 includes a portion (coating portion 31) for coating a wall surface of the liquid flow path 90 and a portion (fixing portion 32) for fixing the vibration plate 10 and the flow path formation substrate 20 continuously. Therefore, the coating film 30 protects the liquid flow path 90 from ink and fixes the vibration plate 10 and the flow path formation substrate 20.

The coating portion 31 is film-formed so as to cover the inner walls of the communication hole-side openings 24, the inner wall of the reservoir-side opening 25, and the inner walls of the pressure chambers 22 on the flow path formation substrate 20.

Further, the fixing portion 32 is film-formed so as to be located between the vibration plate 10 and the wall portion 26 of the flow path formation substrate 20, which corresponds to the outer circumferences of the pressure chambers 22.

Accordingly, the coating film 30 is provided on all of the surface of the vibration plate 10 at the pressure chambers 22 side, a portion between the vibration plate 10 and the flow path formation substrate 20, and the flow path walls of the flow path formation substrate 20 (wall surface at the pressure chambers 22 side, wall surfaces of the communication hole-side openings 24 and the reservoir-side opening 25, which constitute the flow path).

The coating film 30 is formed with a thermoplastic resin having a thickness of 0.5 μm to 20 μm, for example. As the thermoplastic resin, a polypropylene-based resin, a polyethylene-based resin, a polystyrene-based resin, and a paraxylene-based resin (paraxylene-based polymer) that are well known can be applied. Parylene (registered trademark) may be used as an example of the paraxylene-based polymer.

When the coating film 30 is formed by using the thermoplastic resin, thicknesses of the coating portion 31 and the fixing portion 32 have a relation as illustrated in FIG. 3. That is to say, a thickness T2 of the fixing portion 32 of the coating film 30 is larger than a thickness T1 of the coating portion 31 thereof. This indicates that the fixing portion 32 is formed by thermally welding different films provided individually. When the coating film 30 is formed by a technique other than the thermal welding, the thicknesses of the respective portions are not limited thereto, of course. Further, the coating film 30 may have spaces to an extent that functions of the coating film are not interfered when being observed in an enlarged manner.

The piezoelectric elements 40 are formed on the surface (upper surface 11) of the vibration plate 10 at the side opposite to the side fixed to the flow path formation substrate 20. The piezoelectric elements 40 are provided for the respective pressure chambers 22. Each piezoelectric element 40 includes a lower electrode 41, an upper electrode 42, and a piezoelectric body 43 located between the lower electrode 41 and the upper electrode 42. For example, the lower electrode 41 and the upper electrode 42 are formed with a conductive substance such as gold and platinum. The piezoelectric body 43 is formed with a dielectric body such as lead zirconium titanate (PZT), for example.

The sealing plate 60 is fixed to the flow path formation substrate 20 at the lower surface 23 side. The sealing plate 60 is a thin plate member including a plurality of first communication holes 61 and a common supply hole 62.

The first communication holes 61 pass through the sealing plate 60 in the third direction D3 and communicate with the respective communication hole-side openings 24 in the flow path formation substrate 20. Further, the common supply hole 62 is formed by a rectangular slit. The sides of the rectangular slit in a lengthwise direction extend in the second direction D2 and the rectangular slit passes through the sealing plate 60 in the third direction D3.

The sealing plate 60 is formed with ceramics using partially-stabilized zirconia or stabilized zirconia, or a metal.

The reservoir plate 70 is fixed to the surface of the sealing plate 60 at the side that is not fixed to the flow path formation substrate 20. The reservoir plate 70 is a thin plate member including a plurality of second communication holes 71 and a reservoir 72. The second communication holes 71 pass through the reservoir plate 70 in the third direction D3 and communicate with the respective first communication holes 61 in the sealing plate 60. The reservoir 72 is formed by a rectangular slit extending in the second direction D2 and passing through the reservoir plate 70.

The reservoir plate 70 is formed with ceramics using partially-stabilized zirconia or stabilized zirconia, or a metal, for example.

The nozzle plate 80 is fixed to the surface of the reservoir plate 70 at the side that is not fixed to the sealing plate 60. The nozzle plate 80 is a thin plate member in which a plurality of nozzle holes 81 are formed along the second direction D2 at a predetermined interval. The respective nozzle holes 81 are formed so as to communicate with the respective second communication holes 71 of the reservoir plate 70.

The nozzle plate 80 is formed with ceramics using partially-stabilized zirconia or stabilized zirconia, or a metal, for example.

The nozzle plate 80 may employ the following configuration. That is, a plurality of nozzle rows on which the plurality of nozzle holes 81 are formed along the second direction D2 are aligned in parallel in a first direction D1, and one nozzle row and the other nozzle row are arranged so as to be shifted in the second direction D2 (arranged in a so-called zigzag form).

In the liquid ejecting head 1 having the above-mentioned configuration, the respective substrates are fixed in a laminate manner. With this, the pressure chambers 22 communicate with the nozzle holes 81 through the communication hole-side openings 24, the first communication holes 61, and the second communication holes 71. The pressure chambers 22 communicate with the reservoir 72 through the reservoir-side opening 25 and the common supply hole 62. As a result, the nozzle holes 81 and the reservoir 72 communicate with each other through the pressure chambers 22 so as to constitute the liquid flow path 90.

The ink that is supplied from the reservoir 72 is filled into the liquid flow path 90. In this state, if a driving voltage is applied to the lower electrodes 41 and the upper electrodes 42 from a circuit substrate (not illustrated) through cables, the piezoelectric elements 40 are deformed. The deformation of the piezoelectric elements vibrates the vibration plate 10 so as to generate pressure fluctuations in the pressure chambers 22. Then, the pressure fluctuations in the pressure chambers 22 cause the ink filled into the communication holes (first communication holes 61, second communication holes 71) to be ejected to the outside through the nozzle holes 81.

When the increased number of nozzles on the liquid ejecting head 1 are provided densely, the volumes of the pressure chambers 22 are made smaller, so that the pressure fluctuations in the pressure chambers 22 tend to be smaller. In this case, the pressure fluctuations in the pressure chambers 22 can be increased by making the thickness of the vibration plate 10 smaller. However, if the thickness of the vibration plate 10 is made too small, a phenomenon that a solution of ink or the like leaks through the vibration plate 10 (also referred to as ink pass) occurs. If the ink pass occurs in the vibration plate 10, a leak current flows from the piezoelectric elements 40 through the solution as a medium in some cases. The ink pass is significant when the thickness of the vibration plate 10 is equal to or smaller than 3.0 μm. Therefore, the ink pass can be suppressed by forming the coating film 30 on the vibration plate 10 so as to make the thickness of the vibration plate 10 smaller (for example, equal to or smaller than 3.0 μm).

The liquid ejecting head 1 constitutes a part of an ink jet recording head unit including an ink supply path communicating with an ink cartridge and the like and is mounted on an ink jet printer 200. The ink jet printer 200 is an example of a liquid ejecting apparatus.

Figure 4:
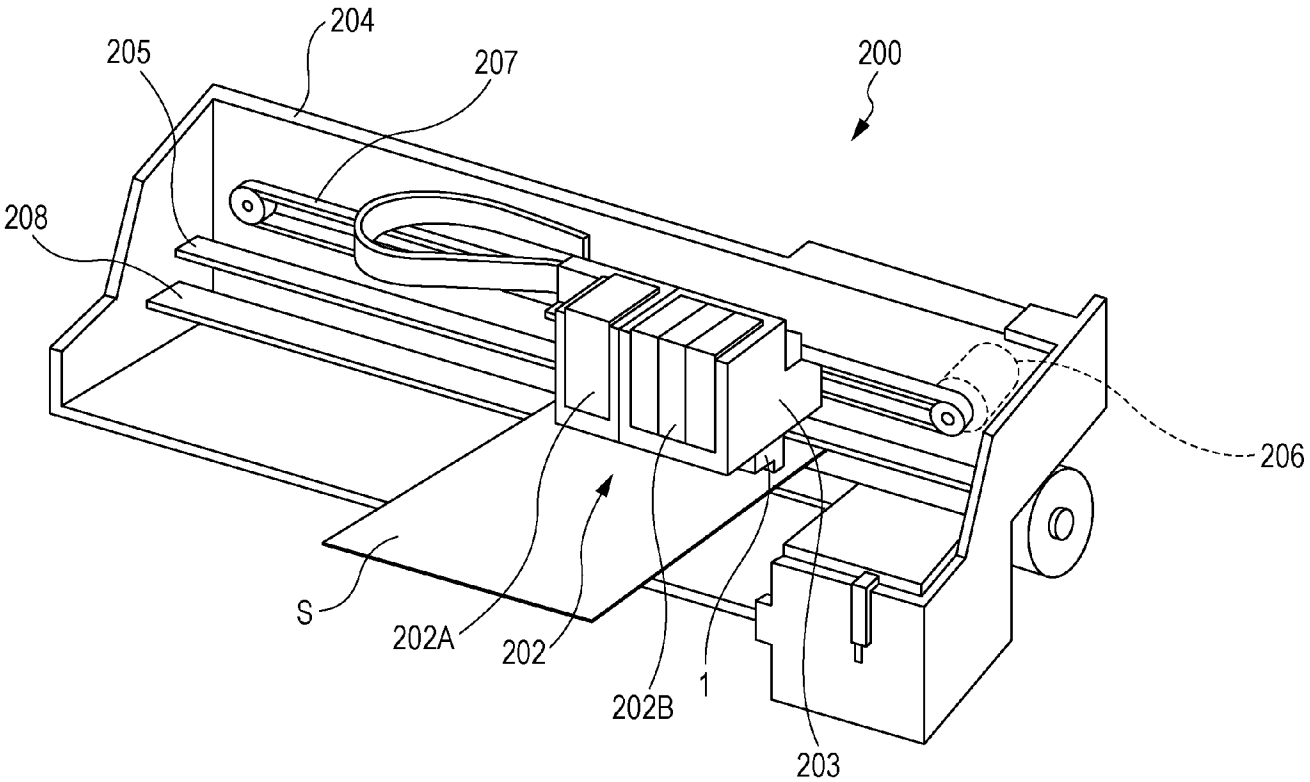
FIG. 4 is a schematic view illustrating an example of an ink jet printer.

FIG. 4 is a schematic view illustrating an example of the ink jet printer 200. In FIG. 4, a reference numeral 1 indicates a part of a housing (head cover) that accommodates therein liquid ejecting heads in a state where nozzle hole surfaces are exposed to the outside. In the ink jet printer 200, for example, ink cartridges 202A and 202B, and the like are provided on an ink jet recording head unit (hereinafter, head unit 202) in a detachable manner. The head unit 202 includes the plurality of liquid ejecting heads 1. A carriage 203 on which the head unit 202 is mounted is provided on a carriage shaft 205 so as to be movable in a shaft direction. The carriage shaft 205 is attached to an apparatus main body 204. If a driving force of a driving motor 206 is transmitted to the carriage 203 through a plurality of gears (not illustrated) and a timing belt 207, the carriage 203 moves along the carriage shaft 205.

A platen 208 is provided on the apparatus main body 204 along the carriage shaft 205. A print medium S supplied by a roller (not illustrated) and the like is transported on the platen 208. Ink is ejected onto the print medium S being transported through the nozzle holes 81 of the liquid ejecting heads 1, so that an arbitrary image is printed on the print medium S. It is to be noted that the ink jet printer 200 is not limited to having a configuration in which the head unit 202 moves as described above and may be also a so-called line head-type printer in which the liquid ejecting heads 1 are fixed and printing is performed only by moving the print medium S, for example.

FIGS. 5A to 5C and FIGS. 6A to 6C are process views for explaining a method of manufacturing the liquid ejecting head 1. Hereinafter, the method of manufacturing the liquid ejecting head 1 is described with reference to FIGS. 5A to 5C and FIGS. 6A to 6C.

First, ceramic sheets before being sintered, which correspond to the vibration plate 10 and the flow path formation substrate 20, are prepared. Then, a punching process is performed on the ceramic sheet corresponding to the flow path formation substrate 20 so as to form through-holes corresponding to the pressure chambers 22, the communication hole-side openings 24, and the reservoir-side opening 25. Then, the respective ceramic sheets are sintered at 1000° C. to 1400° C. so as to form the vibration plate 10 and the flow path formation substrate 20.

Figure 5A:
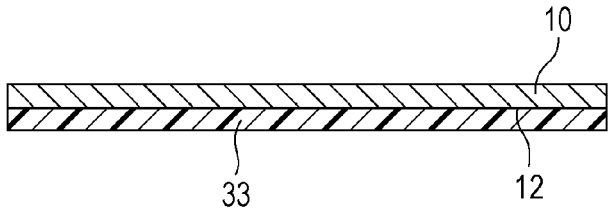
FIGS. 5A to 5C are process views for explaining a method of manufacturing the liquid ejecting head.

Next, as illustrated in FIG. 5A, an upper coating film 33 is formed on a lower surface 12 of the vibration plate 10 (first process). The upper coating film 33 is a film which is a part of the coating film 30. When a paraxylene-based resin is used as a material of the upper coating film 33, for example, well-known parylene (registered trademark) can be used. When the paraxylene-based resin is used, first, paraxylene-based solid dimer is vaporized and thermally decomposed so as to generate a paraxylene-based monomer. Then, the paraxylene-based monomer is made to react with the vibration plate 10 arranged in a chamber so as to form a film. To be more specific, the upper coating film 33 may be formed on the vibration plate 10 by using a chemical vapor deposition (CVD) method.

Figure 5B:
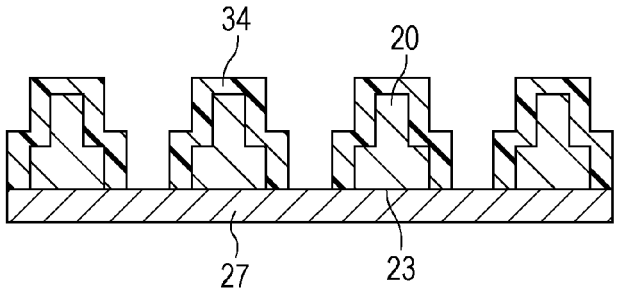

Subsequently, as illustrated in FIG. 5B, a mask film 27 is formed on the lower surface 23 of the flow path formation substrate 20. Then, a lower coating film 34 is formed on the flow path formation substrate 20 at the inner side (portions corresponding to the wall portion 26, the reservoir-side opening 25, and the communication hole-side openings 24) closed by using the mask film 27. As a material of the lower coating film 34, the paraxylene-based resin can be used, for example. The lower coating film 34 is a film which is a part of the coating film 30. The lower coating film 34 can be formed on the flow path formation substrate 20 by using the CVD method or the like as the film formation method, which is same as that for the upper coating film 33.

Figure 5C:
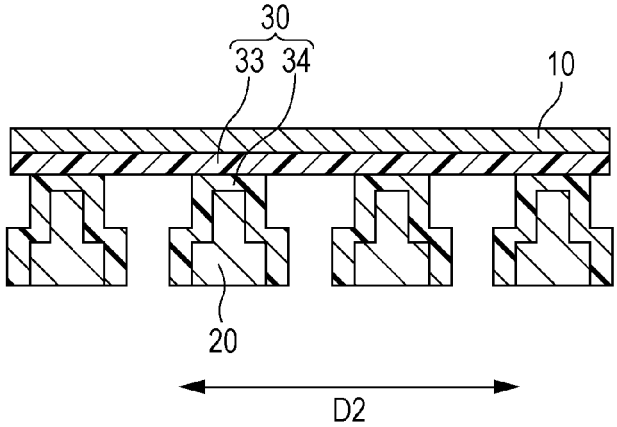

Thereafter, as illustrated in FIG. 5C, the upper coating film 33 formed on the vibration plate 10 and the lower coating film 34 formed on the flow path formation substrate 20 are welded thermally (second process, third process). As an example, first, the vibration plate 10 and the flow path formation substrate 20 are laminated. Thereafter, a pressure (1.4 Mpa to 2.0 Mpa) is applied to a portion of the upper coating film 33, which corresponds to the fixing portion 32, and a portion of the lower coating film 34, which corresponds to the fixing portion 32. Then, each of the upper coating film 33 and the lower coating film 34 is heated to be equal to or higher than a melting point by using a heater or the like. When the coating film 30 is formed with the paraxylene-based resin, each of the upper coating film 33 and the lower coating film 34 is heated at 140° C. to 200° C. They are bonded to be welded while being heated in the above-mentioned manner. Therefore, the upper coating film 33 and the lower coating film 34 are integrated so as to form the coating film 30. Accordingly, all the surfaces (flow path walls) of the pressure chambers 22, the reservoir-side opening 25, and the communication hole-side openings 24 at the sides on which the liquid flows are coated with the coating film 30.

Figure 6A:
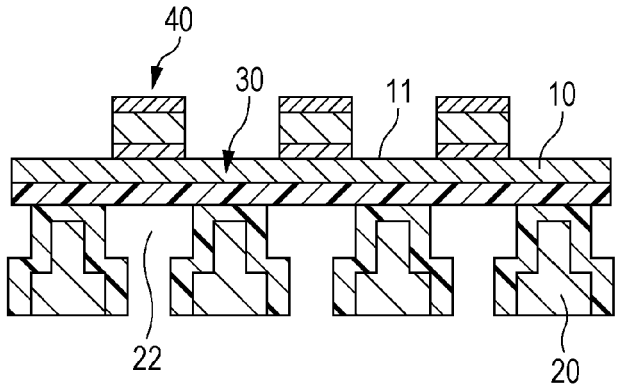
FIGS. 6A to 6C are process views for explaining the method of manufacturing the liquid ejecting head.

Next, as illustrated in FIG. 6A, the piezoelectric elements 40 are formed on the upper surface 11 of the vibration plate 10 so as to correspond to the positions of the pressure chambers 22. As an example of the method of forming the piezoelectric elements 40, the lower electrodes made of Au are formed on the upper surface 11 of the vibration plate 10. Then, the piezoelectric bodies 43 made of PZT are formed on the lower electrodes 41. Subsequently, the upper electrodes 42 corresponding to the pressure chambers 22 are formed on the piezoelectric bodies 43.

Figure 6B:
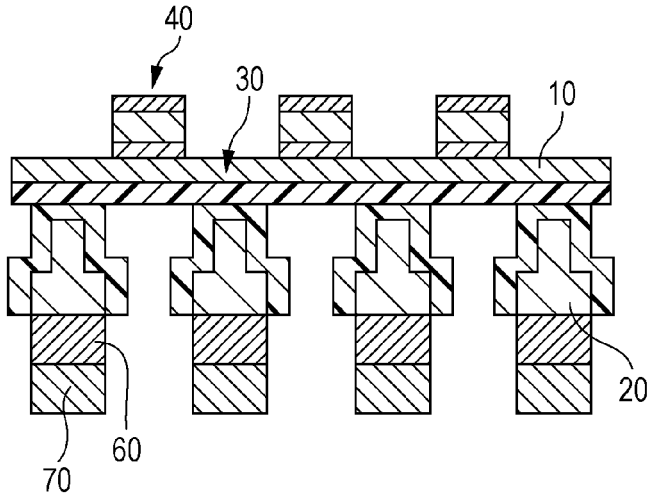

Then, as illustrated in FIG. 6B, the sealing plate 60 is bonded to the flow path formation substrate 20. The sealing plate 60 is bonded to the flow path formation substrate 20 by using an adhesive, for example. Further, the reservoir plate 70 is bonded to the sealing plate 60. The reservoir plate 70 is bonded to the sealing plate by using the adhesive, for example. An epoxy-based adhesive can be used as the adhesive. The mask film 27 is formed before the lower coating film 34 is formed so as not to form the lower coating film 34 on the lower surface 23 of the flow path formation substrate 20. This enables the flow path formation substrate 20 and the sealing plate 60 to be bonded to each other easily with an adhesive different from the coating film 30.

Figure 6C:
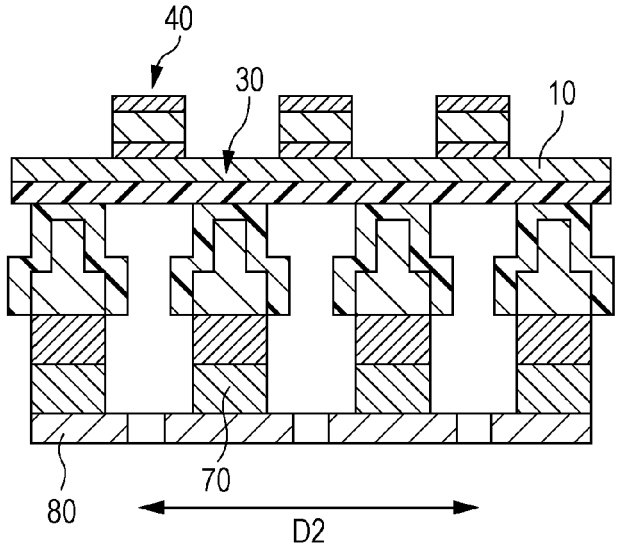

Finally, as illustrated in FIG. 6C, the nozzle plate 80 is bonded to the reservoir plate 70. The nozzle plate 80 is bonded to the reservoir plate 70 by using an adhesive, for example. In the same manner as described above, the epoxy-based adhesive can be used as the adhesive.

It is to be noted that the sealing plate 60, the reservoir plate 70, and the nozzle plate 80 can be formed by performing the punching process on green sheets as materials, and then, sintering them.

The liquid ejecting head 1 according to the first embodiment is manufactured with the above-mentioned processes.

As described above, in the first embodiment, the coating film 30 includes the coating portion 31 for coating the flow path wall of the vibration plate 10 and the fixing portion 32 for fixing the vibration plate 10 and the flow path formation substrate 20 continuously by using the same material. Therefore, the liquid flow path 90 can be coated with the coating film 30 without inhibiting the fixing of the substrates.

In addition, if the pressure chambers 22 are formed on the flow path formation substrate 20 in a fine manner, it is difficult to generate a uniform film even if the coating film 30 is formed by a well-known method such as the CVD method. Therefore, if the films are formed on the vibration plate 10 and the flow path formation substrate 20 separately, and then, the substrates are fixed to each other by making the films adhere to each other, the film thickness of the coating film formed within the liquid flow path 90 can be made uniform.

Further, the substrates are fixed to each other by welding the coating film 30 thermally, so that an amount of the adhesive can be reduced.

Second Embodiment

Figure 7:
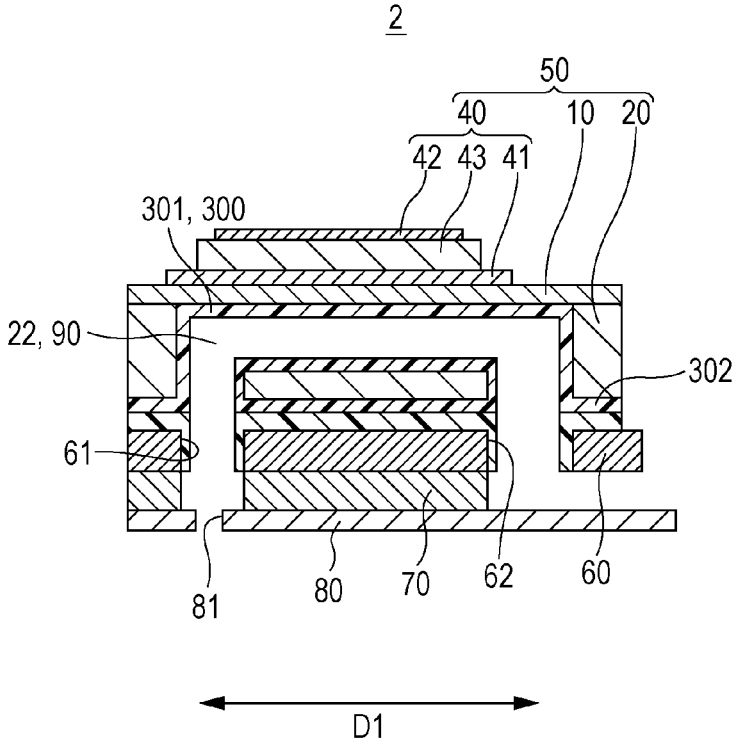
FIG. 7 is a cross-sectional view illustrating a liquid ejecting head according to a second embodiment.

FIG. 7 is a cross-sectional view illustrating a liquid ejecting head 2 according to a second embodiment. The liquid ejecting head 2 is different from the liquid ejecting head 1 according to the first embodiment in a configuration in which a coating film 300 is provided between the flow path formation substrate 20 and the sealing plate 60.

The liquid ejecting head 2 includes the flow path unit 50, the sealing plate 60, the reservoir plate 70, and the nozzle plate 80 as in the first embodiment. Further, the flow path unit 50, the sealing plate 60, the reservoir plate 70, and the nozzle plate 80 are fixed in a laminate manner so as to constitute the liquid flow path 90 including the pressure chambers 22 as a part.

The flow path unit 50 includes the vibration plate 10, the flow path formation substrate 20, and the piezoelectric elements 40.

Further, the liquid ejecting head 2 includes the coating film 300. The coating film 300 includes a portion located between the flow path formation substrate 20 and the sealing plate 60 and a portion covering the inner wall of the liquid flow path 90, which are provided continuously. In FIG. 7, the coating film 300 includes a coating portion 301 and a fixing portion 302 which are provided continuously. The coating portion 301 covers the wall surfaces of the pressure chambers 22 (the surface of the vibration plate 10 at the pressure chambers 22 side, the wall portion 26 of the flow path formation substrate 20 at the pressure chambers 22 side, the wall surfaces of the communication hole-side openings 24 on the flow path formation substrate 20, the wall surface of the reservoir-side opening 25 on the flow path formation substrate 20), and the wall surfaces of the first communication holes 61 and the wall surface of the common supply hole 62 on the sealing plate 60. The fixing portion 302 is located between the flow path formation substrate 20 and the sealing plate 60 and bonds both the substrates to each other. Therefore, in the second embodiment, the flow path formation substrate 20 functions as a first flow path substrate and the sealing plate 60 functions as a second flow path substrate.

As in the first embodiment, a polypropylene-based resin, a polyethylene-based resin, a polystyrene-based resin, and a paraxylene-based resin (paraxylene-based polymer) that are well known as thermoplastic resins can be applied to the coating film 300.

As in the first embodiment, when the coating film 300 is formed by thermal welding, a thickness of the fixing portion 302 of the coating film 300 is larger than a thickness of the coating portion 301 thereof.

FIGS. 8A to 8C and FIGS. 9A to 9C are process views for explaining a method of manufacturing the liquid ejecting head 2. Hereinafter, the method of manufacturing the liquid ejecting head 2 according to the second embodiment is described with reference to FIGS. 8A to 8C and FIGS. 9A to 9C.

Figure 8A:
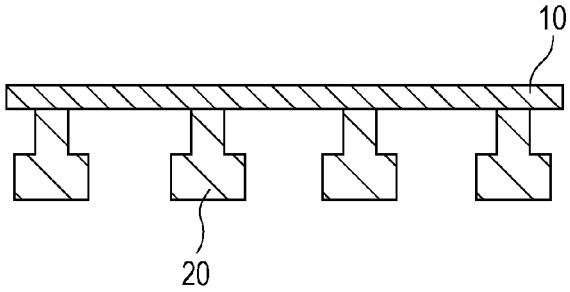
FIGS. 8A to 8C are process views for explaining a method of manufacturing the liquid ejecting head.

First, as illustrated in FIG. 8A, a green sheet corresponding to the vibration plate 10 and a green sheet corresponding to the flow path formation substrate 20 are laminated. Then, the laminated green sheets are integrally sintered at a range from 1000° C. to 1400° C. so as to obtain the vibration plate 10 and the flow path formation substrate 20.

Figure 8B:
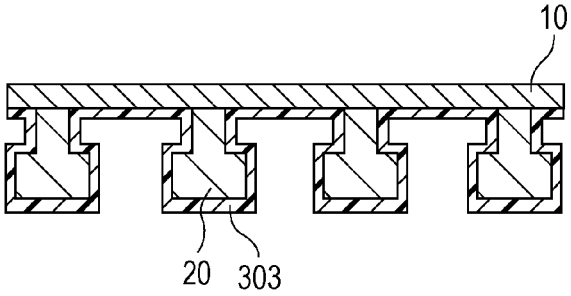

Subsequently, as illustrated in FIG. 8B, an upper coating film 303 is formed in the flow path (flow path wall) formed by the vibration plate 10 and the flow path formation substrate 20. It is to be noted that the upper coating film 303 is also formed on the lower surface 23 of the flow path formation substrate 20. The upper coating film 303 is a film which is a part of the coating film 300. As a material of the upper coating film 303, for example, the paraxylene-based resin can be used. For example, the CVD method can be used as the film formation method of the upper coating film 303.

Figure 8C:
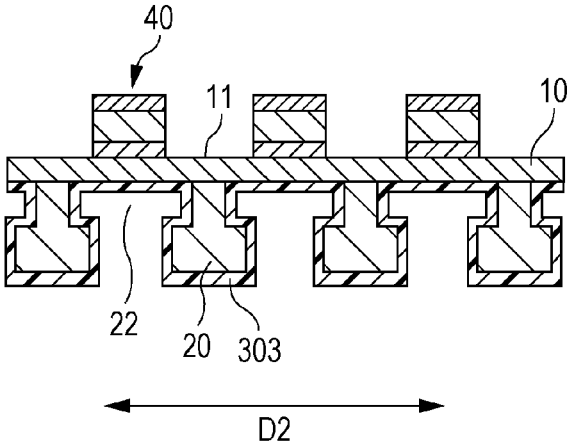

Then, as illustrated in FIG. 8C, the piezoelectric elements 40 are formed on the upper surface 11 of the vibration plate 10 so as to correspond to the positions of the pressure chambers 22.

Figure 9A:
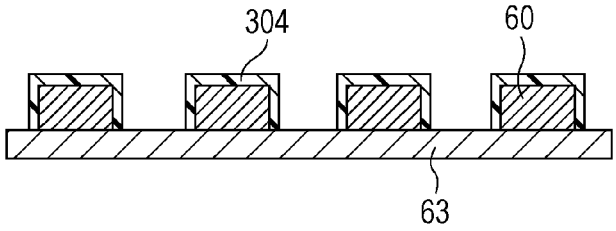
FIGS. 9A to 9C are process views for explaining the method of manufacturing the liquid ejecting head.

Next, as illustrated in FIG. 9A, a mask film 63 is formed on one surface of the sealing plate 60 and a lower coating film 304 is formed. The lower coating film 304 is a film which is a part of the coating film 300. As a material of the lower coating film 304, for example, the paraxylene-based resin can be used. For example, the CVD method can be used as the film formation method of the lower coating film 304.

Figure 9B:
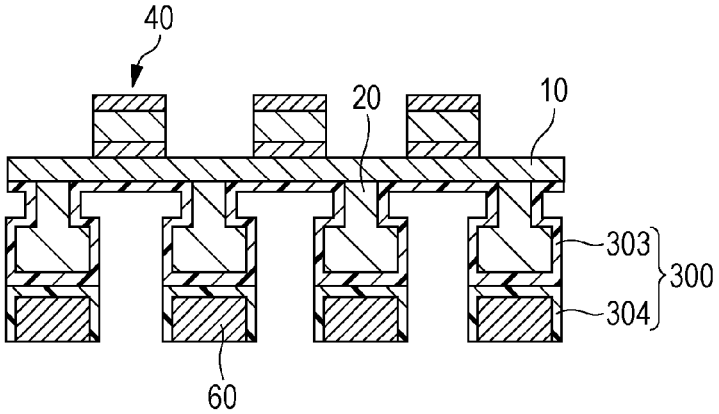

Thereafter, as illustrated in FIG. 9B, the upper coating film 303 formed on the flow path formation substrate and the lower coating film 304 formed on the sealing plate 60 are welded thermally at equal to or higher than a melting point. When the coating film 300 is formed with the paraxylene-based resin, the melting point in a range from 140° C. to 200° C. can be employed. Further, a range from 1.4 Mpa to 2.0 Mpa can be employed as the pressure at the time of bonding.

Therefore, the upper coating film 303 and the lower coating film 304 are integrated so as to form the coating film 300.

Figure 9C:
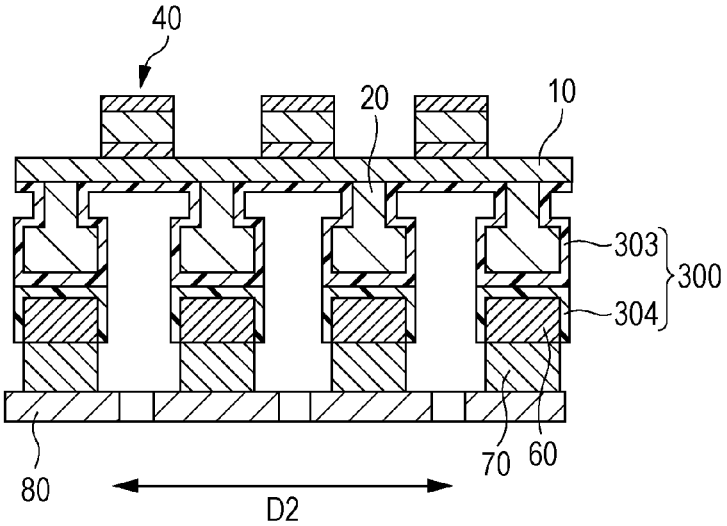

Then, as illustrated in FIG. 9C, the reservoir plate 70 is bonded to the sealing plate 60. Further, the nozzle plate 80 is bonded to the reservoir plate 70. The reservoir plate 70 and the nozzle plate 80 are bonded by using an adhesive made of a material different from the above-mentioned coating film 300, for example.

The liquid ejecting head 2 according to the second embodiment is manufactured with the above-mentioned processes.

With the second embodiment, the same effects as those achieved by the first embodiment can be obtained. Further, a uniform film can be formed by selectively using the existing film formation method such as the CVD method or the film formation method according to the invention in accordance with the shape of the flow path, such as the inner diameter thereof.

In the second embodiment, the pressure chambers 22, the communication hole-side openings 24, and the reservoir-side opening 25 are provided on the same flow path formation substrate 20. Alternatively, the substrates may be separated into a substrate on which the pressure chambers 22 are formed and a substrate on which the communication hole-side openings 24 and the reservoir-side opening 25 are formed as in the first embodiment.

Other Embodiments

There are various embodiments in the invention. The basic configuration of the liquid ejecting heads according to the embodiments is not limited to those as described above. The members that are fixed by using the coating film are not limited to those as described above. The invention can be applied to fixing between various members and can be applied to fixing at equal to or more than two places. Further, the upper coating film and the lower coating film are not necessarily made of the exactly same material. It is sufficient that a material capable of fixing the members with a necessary strength by thermal welding as described above is used therefor. Further, the configuration in which the portion corresponding to the coating portion and the portion corresponding to the fixing portion are made of the same material in at least a part thereof and made of different materials in other parts thereof is employed. For example, when the respective coating films are formed by resins, films formed with resins made of different materials may be welded. Therefore, the viscosity, the strength, the chemical resistance, and the like of the materials that are used can be combined optimally based on shapes of the portions on which the coating film is formed and usage conditions thereof.

The invention is widely applied to general liquid ejecting heads and it is needless to say that the invention can be also applied to liquid ejecting heads which eject liquids other than ink. As other liquid ejecting heads, various recording heads used for image recording apparatuses such as a printer, color material ejecting heads used for manufacturing color filters of a liquid crystal display, electrode material ejecting heads used for forming electrodes of an organic EL display and a field emission display (FED), bioorganic compound ejecting heads used for manufacturing a bio chip, and the like can be exemplified.

It is needless to say that the invention is not limited to the above-mentioned embodiments.

That is to say, members, configurations, and the like as disclosed in the above-mentioned embodiments, which can be replaced by one another, may be applied while combinations thereof are changed appropriately.

The members, the configurations, and the like as disclosed in the above-mentioned embodiments may be replaced appropriately by well-known replaceable members, configurations, and the like, and combinations thereof may be changed to be applied.

The members, the configurations, and the like as disclosed in the above-mentioned embodiments may be replaced appropriately by members, configurations, and the like, which can be supposed as substitutions by those skilled in the art based on the well-known techniques and the like, and combinations thereof may be changed to be applied.

The entire disclosure of Japanese Patent Application No. 2013-033185, filed Feb. 22, 2013 is incorporated by reference herein.

What is claimed is:

1. A flow path unit having a liquid flow path through which liquid flows comprising:

a first flow path substrate that has a bottom surface;

a first coating film that is formed as a top layer on the bottom surface of the first flow path substrate and that is part of a flow path wall of the liquid flow path;

a second flow path substrate that has a top surface and a side surface; and a second coating film that is formed as a top layer on the top surface and the side surface of the second flow path substrate, the second coating film formed as the top layer on the side surface being part of the flow path wall of the liquid flow path, wherein part of the bottom surface of the first flow path substrate and the top surface of the second flow path substrate are fixed via the first and second coating films, and the first and second coating films are made of a same resin material.

2. The flow path unit according to claim 1, wherein the same resin material is a thermoplastic resin.

3. The flow path unit according to claim 1, wherein a combined film thickness of the first and second coating films in the part where the bottom surface of the first flow path substrate and the top surface of the second flow path substrate are fixed via the first and second coating films is larger than a film thickness of either of the first and second coating films being configured as the part of the flow path wall of the liquid flow path.

4. The flow path unit according to claim 1, wherein any one of the first flow path substrate and the second flow path substrate is made of ceramics.

5. A liquid ejecting head comprising:

the path unit according to claim 1; and a nozzle plate including a nozzle hole communicating with the liquid flow path.

6. A liquid ejecting apparatus comprising the liquid ejecting head according to claim 5.

7. A method of manufacturing a flow path unit having a liquid flow path through which liquid flows comprising:

preparing a first flow path substrate that has a bottom surface;

forming a first coating film as a top layer on the bottom surface of the first flow path substrate, the first coating film being part of a flow path wall of the liquid flow path;

preparing a second flow path substrate that has a top surface and a side surface;

forming a second coating film as a top layer on the top surface and the side surface of the second flow path substrate, the second coating film being part of the flow path wall of the liquid flow path;

stacking the first and second flow path substrates so that the first coating film contacts the second coating film; and fixing the first and second flow path substrates by heating the first and second coating films, wherein the first and second coating films are made of a same resin material.

8. The method of manufacturing a flow path unit according to claim 7, wherein the same resin material is a thermoplastic resin.

9. The method of manufacturing a flow path unit according to claim 7, wherein a combined film thickness of the first and second coating films in part where the first flow path substrate and the second flow path substrate are fixed via the first and second coating films is larger than a film thickness of either of the first and second coating films being configured as the part of the flow path wall of the liquid flow path.

10. The method of manufacturing a flow path unit according to claim 7, wherein any one of the first flow path substrate and the second flow path substrate is made of ceramics.

* * * * *